US008955502B2

(12) United States Patent
Macy

(10) Patent No.: US 8,955,502 B2
(45) Date of Patent: Feb. 17, 2015

(54) BOTTOM LOADING PAINTBALL FEED SYSTEM

(75) Inventor: Omar Alonso Macy, San Jose, CA (US)

(73) Assignee: Real Action Paintball (Rap4), Gilroy, CA (US)

( * ) Notice: Subject to any disclaimer, the term of this patent is extended or adjusted under 35 U.S.C. 154(b) by 684 days.

(21) Appl. No.: 12/882,196

(22) Filed: Sep. 14, 2010

(65) Prior Publication Data

US 2012/0060811 A1 Mar. 15, 2012

(51) Int. Cl.
*F41B 11/00* (2013.01)
*F41B 11/57* (2013.01)

(52) U.S. Cl.
CPC ..... *F41B 11/57* (2013.01)
USPC ..... 124/51.1

(58) Field of Classification Search
USPC ..... 124/51.1
See application file for complete search history.

(56) References Cited

U.S. PATENT DOCUMENTS

| | | | | |
|---|---|---|---|---|
| 2,437,727 | A * | 3/1948 | Drumheller | 124/27 |
| 5,213,110 | A | 5/1993 | Kedem et al. | |
| 5,619,977 | A * | 4/1997 | Gatin | 124/7 |
| 5,791,325 | A | 8/1998 | Anderson | |
| 5,947,100 | A | 9/1999 | Anderson | |
| 5,954,042 | A | 9/1999 | Harvey | |
| 6,109,252 | A | 8/2000 | Stevens | |
| 6,467,473 | B1 * | 10/2002 | Kostiopoulos | 124/51.1 |
| 6,502,567 | B1 | 1/2003 | Christopher et al. | |
| 6,684,873 | B1 | 2/2004 | Anderson et al. | |
| 6,701,907 | B2 | 3/2004 | Christopher et al. | |
| 6,792,933 | B2 | 9/2004 | Christopher et al. | |
| D544,047 | S | 6/2007 | Bell et al. | |
| 7,343,909 | B2 | 3/2008 | Christopher et al. | |
| 2006/0283431 | A1 * | 12/2006 | Lee et al. | 124/41.1 |
| 2007/0028908 | A1 * | 2/2007 | Deak | 124/73 |
| 2007/0101981 | A1 * | 5/2007 | Chen | 124/51.1 |

FOREIGN PATENT DOCUMENTS

| | | |
|---|---|---|
| GB | 2322438 | 1/1999 |

* cited by examiner

*Primary Examiner* — Gene Kim
*Assistant Examiner* — Amir Klayman
(74) *Attorney, Agent, or Firm* — James M. Wu; JW Law Group

(57) ABSTRACT

A paintball propelling device capable of propelling paintballs using bottom feed magazine is disclosed. The paintball propelling device, in one embodiment, includes a receiver and a bottom feed magazine. The receiver, for example, has a top surface facing upward and a bottom surface facing downward at the ground, wherein the bottom surface of the receiver includes a bottom feed port. The bottom feed magazine provides paintballs to the receiver via a bottom feed port of the receiver. The bottom feed magazine, in one aspect, includes a feed tube, an L-shaped tube, and one-way paintball stopper. The feed tube transfers the paintballs from the bottom or floor of the bottom feed magazine to the top of the bottom feed magazine. The L-shaped tube assists to transfer paintballs from paintball reservoir to the feed tube. The one-way paintball stopper is configured to hold paintballs from leaving the feed tube back to the paintball reservoir.

20 Claims, 16 Drawing Sheets

BOTTOM LOADING PAINTBALL FEED SYSTEM

FIELD

The present invention relates to paintball markers. More specifically, the present invention relates to paintball feed systems.

BACKGROUND

With increasing popularity of paintball tournaments as well as professional trainings such as military and sporting practice, more accurate and realistic looking paintball guns or markers are in demand. For example, the success of training or competition depends on how quickly an operator of a paintball marker can eliminate opponents by hitting them with paintballs or paint projectiles. A problem associated with a conventional paintball marker or gun is that the accuracy of paintball marker is relatively poor partially due to the traditional design of the paintball guns or markers.

A conventional paintball gun or marker, for example, typically loads paintballs from a hopper into the paintball gun via a gravitational force. The hopper, which is mounted on the top of paintball guns or receiver, typically obstructs aiming capability of an operator. An operator usually has a difficult time taking proper aim via a front sight on the barrel.

Another problem associated with a conventional paintball marker or gun with a hopper mounted on top of the receiver is that a typical paintball gun deviates from a real gun whereby using paintball marker as training exercise degrades the effectiveness of military and/or police field training.

SUMMARY OF THE INVENTION

Embodiments of the present invention disclose a paintball propelling device capable of propelling projectiles such as paintballs using a bottom feed magazine. The paintball propelling device, in one embodiment, includes a receiver and a bottom feed magazine. The receiver, for example, has a top surface facing upward and a bottom surface facing downward at the ground, wherein the bottom surface of the receiver includes a bottom feed port. The bottom feed magazine provides paintballs to the receiver via a bottom feed port of the receiver. The bottom feed magazine, in one aspect, includes a feed tube, an L-shaped tube, and one-way paintball stopper. The feed tube transfers the paintballs from the bottom or floor of the bottom feed magazine to the top of the bottom feed magazine. The L-shaped tube assists to transfer paintballs from paintball reservoir to the feed tube. The one-way paintball stopper is configured to hold paintballs from leaving the feed tube back to the paintball reservoir.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
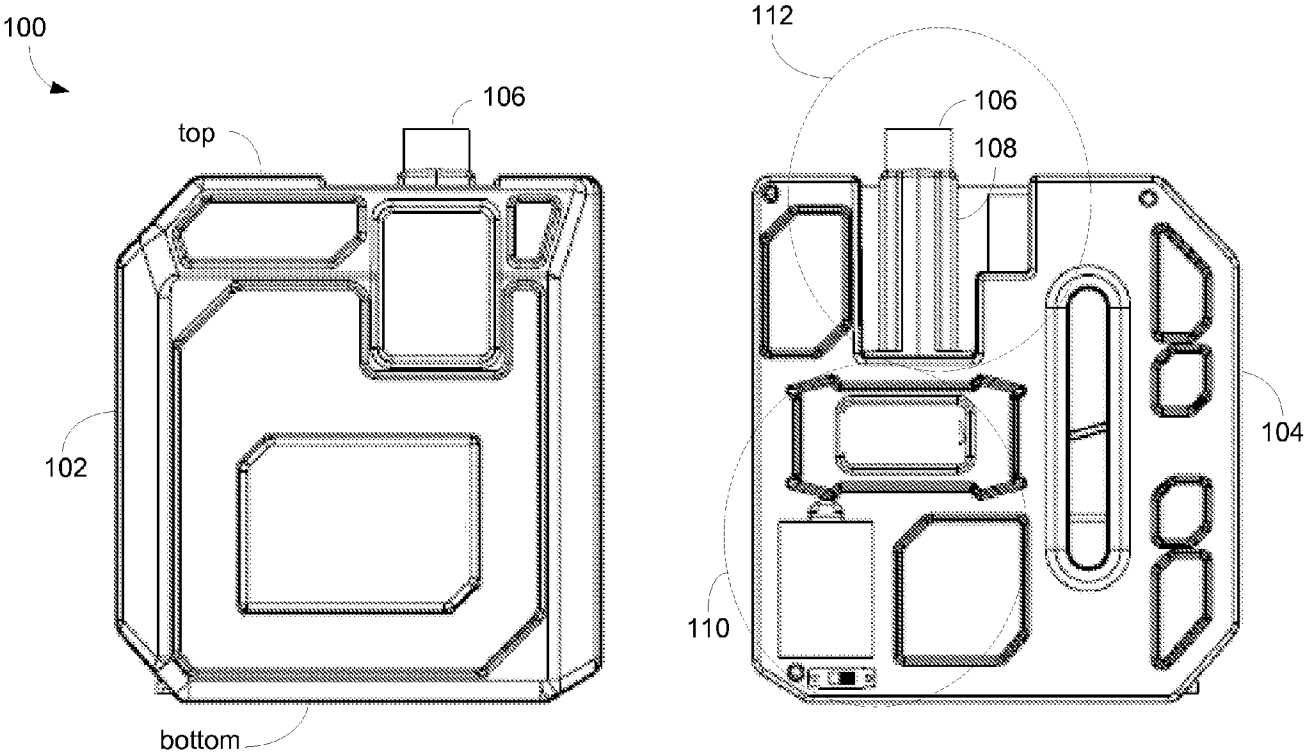
FIGS. 1A-C are diagrams illustrating a bottom feed magazine in accordance with one embodiment of the present invention.

Exemplary embodiment(s) of the present invention is described herein in the context of a method, system and apparatus of a bottom feed magazine allowing a paintball marker to load paintballs from bottom of the marker.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Embodiments of the present invention disclose a paintball marker capable of receiving paintballs loading from a bottom feed magazine. The paintball marker, in one embodiment, includes a receiver and a bottom feed magazine. The receiver, for example, has a top surface facing upward and a bottom surface facing downward at the ground, wherein the bottom surface of the receiver has a bottom feed port. The bottom feed magazine provides paintballs to the receiver via a bottom feed port of the receiver. The bottom feed magazine, in one aspect, includes a feed tube, an L-shaped tube, and one-way paintball stopper. While the L-shaped tube assists to transfer paintballs from paintball reservoir to the feed tube, the feed tube transfers paintballs from the floor of the bottom feed magazine to the top of the bottom feed magazine. The one-way paintball stopper is configured to hold paintballs from leaving the feed tube back to the paintball reservoir.

Figure 1B:
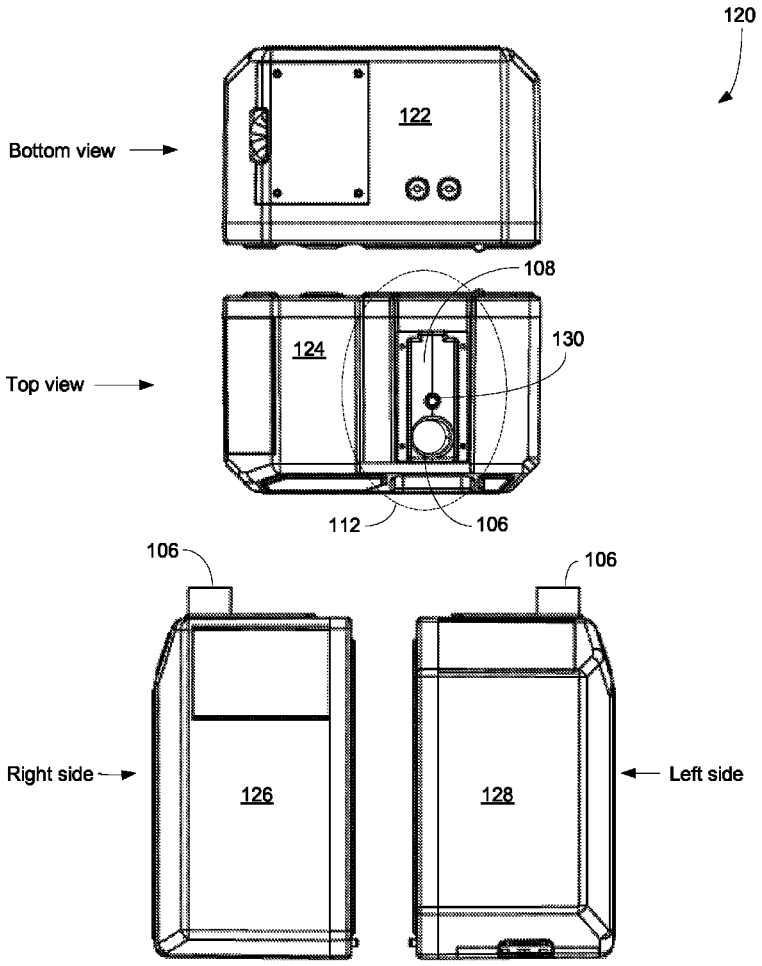
Figure 1C:
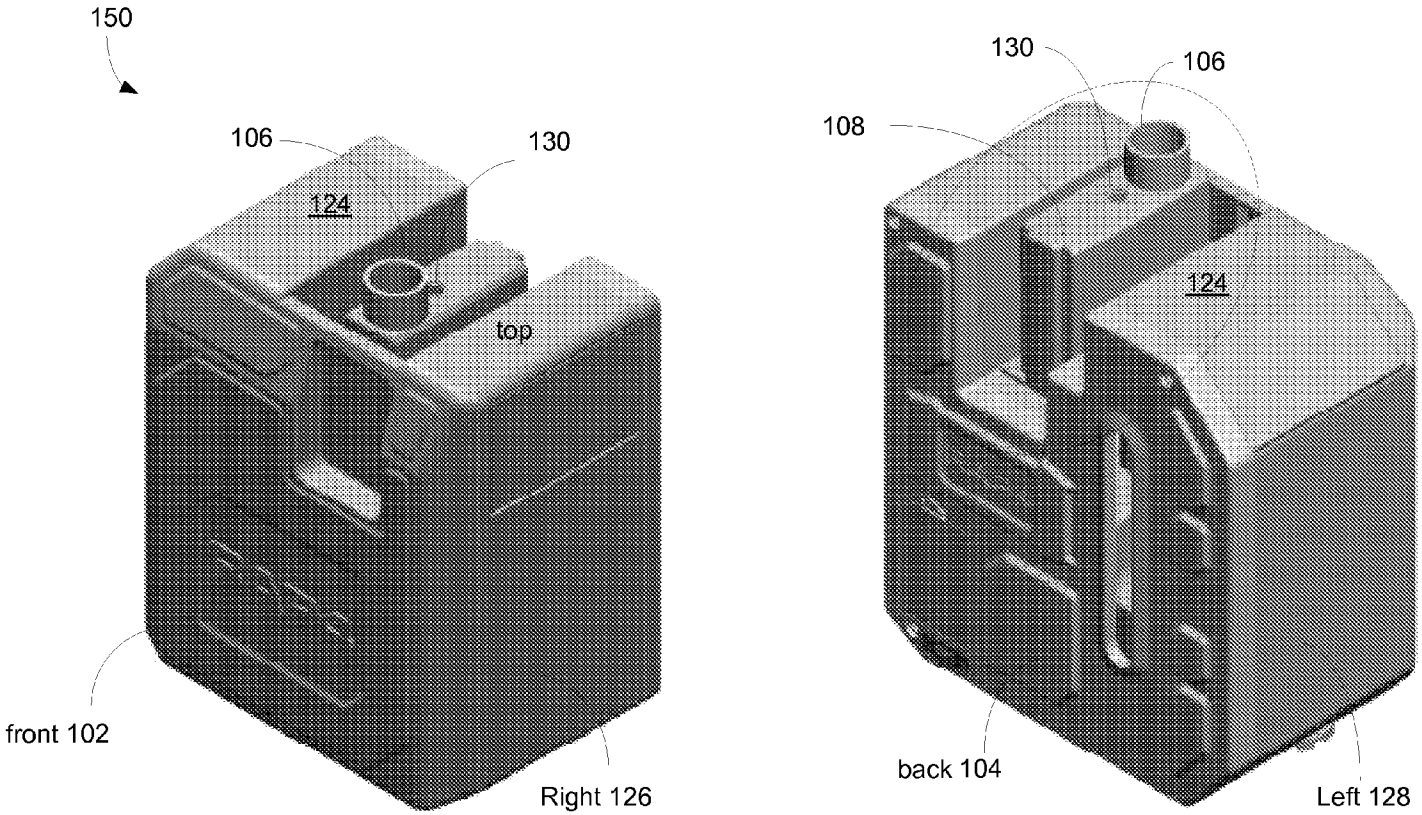

FIGS. 1A-C illustrate a bottom feed magazine in accordance with one embodiment of the present invention. FIG. 1A illustrates a diagram 100 showing a front view 102 and a back view 104 of the bottom feed magazine. FIG. 1B illustrates a diagram 120 showing a bottom view 122, a top view 124, a right side view 126, and a left side view 128 of the bottom feed magazine. FIG. 1C illustrates a three-dimensional ("3D") diagram 150 showing a perspective view of the bottom feed magazine depicting various features. The bottom feed magazine, in one aspect, can be fabricated or casted with solid or rigid materials which can stand a range of predefined stresses as well as temperature variations. The materials include, but not limited to, metal, aluminum, polymers, alloy, composite plastics, and the like. It should be noted that the underlying concept of the exemplary embodiment(s) of the present invention would not change if one or more components (or elements) were added to or removed from diagrams 100, 120, and 150.

A bottom feed magazine is a paintball ammunition storage and is capable of coupling to a paintball marker for loading paintballs to the marker for repetitive propelling of paintballs. Paintballs are considered as ammunition for the paintball gun or marker and they, for example, are round or spherical shaped capsules containing dye substances. Upon an impact of a paintball, the paintball leaves a colored marker. Magazines, for example, can be fixed or removable from paintball markers, wherein a magazine can be an integral part of paintball markers. Alternatively, a magazine may be removable from a paintball marker. Note that datable bottom feed magazine may also be referred to as a magazine clip.

A function of bottom feed magazine is to transfer paintballs stored in the magazine into a place or chamber of a receiver whereby the paintballs can be loaded and/or launched. Receiver of a paintball marker can also be referred to as an assembly, body, or frame which is a part of physical structure that houses various mechanical and/or operating parts or components. The terms "receiver," "body," "assembly," and "frame" are hereinafter used interchangeably.

Diagram 100 also includes a coupling mechanism 112, a loading port 106, and a feed latch 108. Loading port 106 is configured to couple to a bottom feed port of a receiver for transporting paintballs from paintball reservoir in the bottom feed magazine up to a chamber of receiver for propelling or firing. Loading port 106, in one embodiment, is an opening having a predefined dimension that allows conventional paintballs to pass through.

Coupling mechanism 112, in one embodiment, is structured in such a way that it allows the bottom feed magazine to be attached to a bottom portion of a receiver. The layout of coupling mechanism 112, for example, may change depending on the applications. Applications may vary depending on which types of paintball marker are to be attached with.

Top view 124 of diagram 120 depicts a more detailed view of feed latch 108 that, in one aspect, includes a loading port 106 and an optical signal receiver 130. Depending on the applications, the shape or dimensions of feed latch 108 may change to accommodate physical structure of a receiver of paintball marker. In one embodiment, at least a portion of feed latch 108 extends into a receiver once the bottom feed magazine is attached to the receiver.

Optical signal receiver 130, in one embodiment, is an optical receiver capable of detecting a predefined wavelength and/or electromagnetic radiation. The predefined wavelength and/or electromagnetic radiation includes, but not limited to, visible light, infrared, microwaves, or ultraviolet radiations. To simply the foregoing discussion, light (visible light) is used to refer as infrared, microwaves, ultraviolet radiations, et cetera. Upon detecting a predefined a light, the bottom feed magazine provides one or more paintballs to the attached receiver in accordance with the detected light.

When bottom feed magazine is coupled to a receiver (not shown in FIGS. 1A-C), the bottom feed magazine, which is powered by a bottom feed mechanism, generates a force which is in a direction opposite from the gravitation force to push a paintball from the magazine into a receiver of paintball marker through loading port 106. After the paintball in the receiver is fired or released, optical lighting device located in the receiver emits an optical signal or light instructing the magazine to feed another paintball to the receiver through loading port 106.

It should be noted that various other features such as knock-outs 110 and grooves are relating to aesthetic and/or other functional values whereby they do not alter the underlying concept of the exemplary embodiment(s) of the present invention if the shape of knock-outs or a groove changes.

Figure 2A:
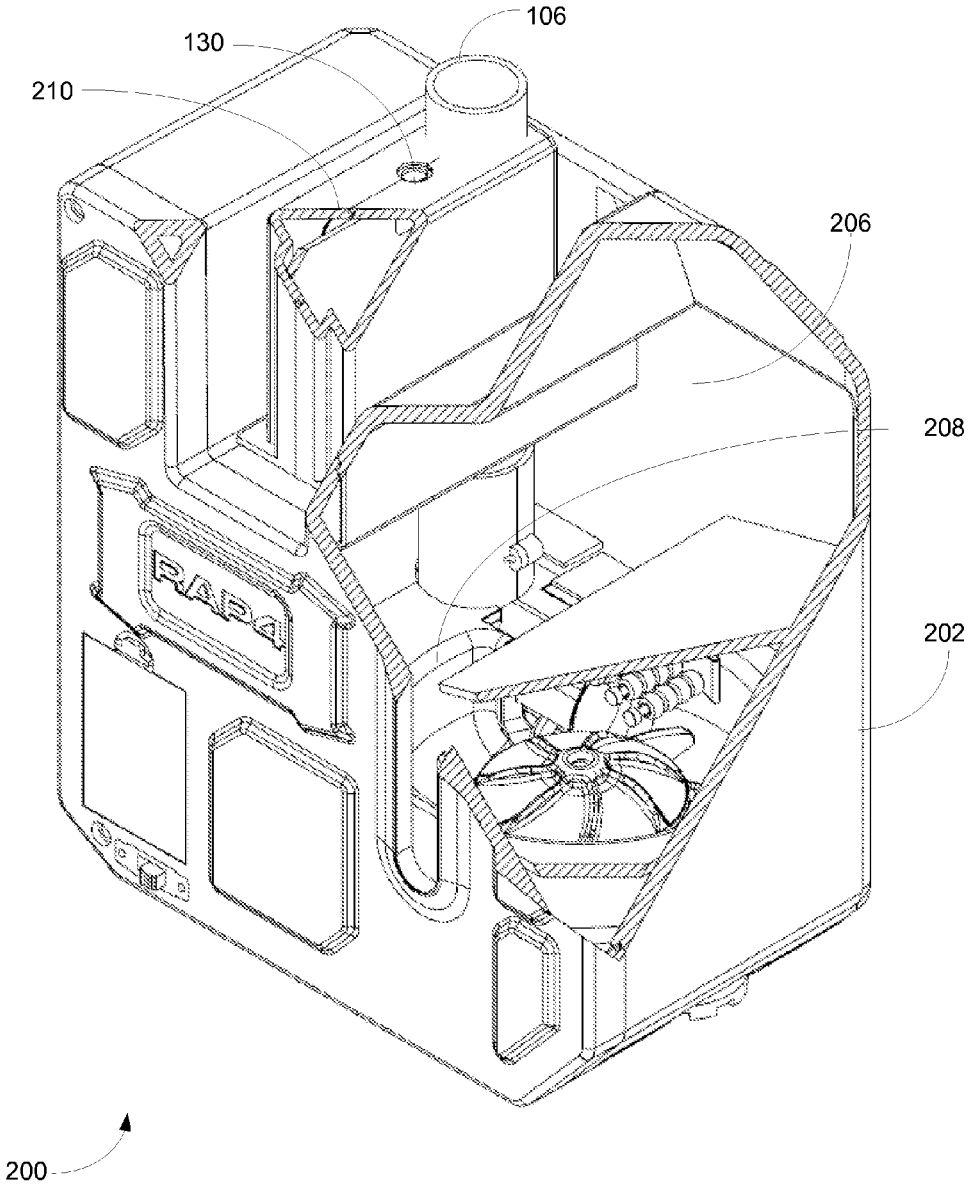
FIGS. 2A-C are diagrams illustrating a cut-out view of a bottom feed magazine in accordance with one embodiment of the present invention.
Figure 2B:
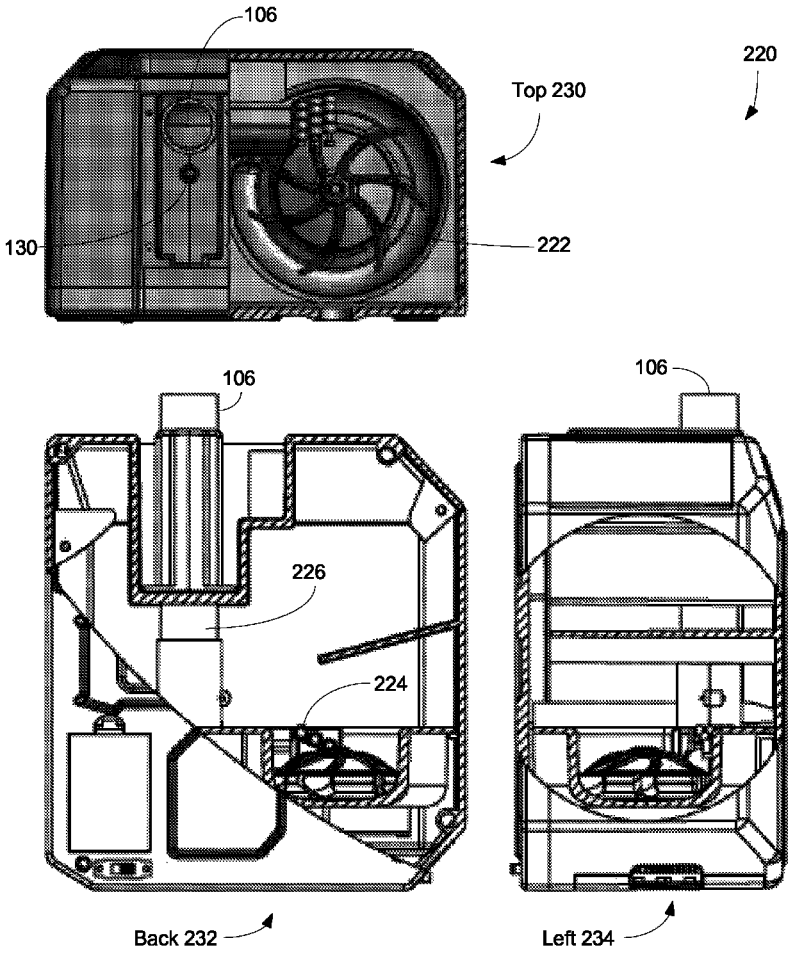
Figure 2C:
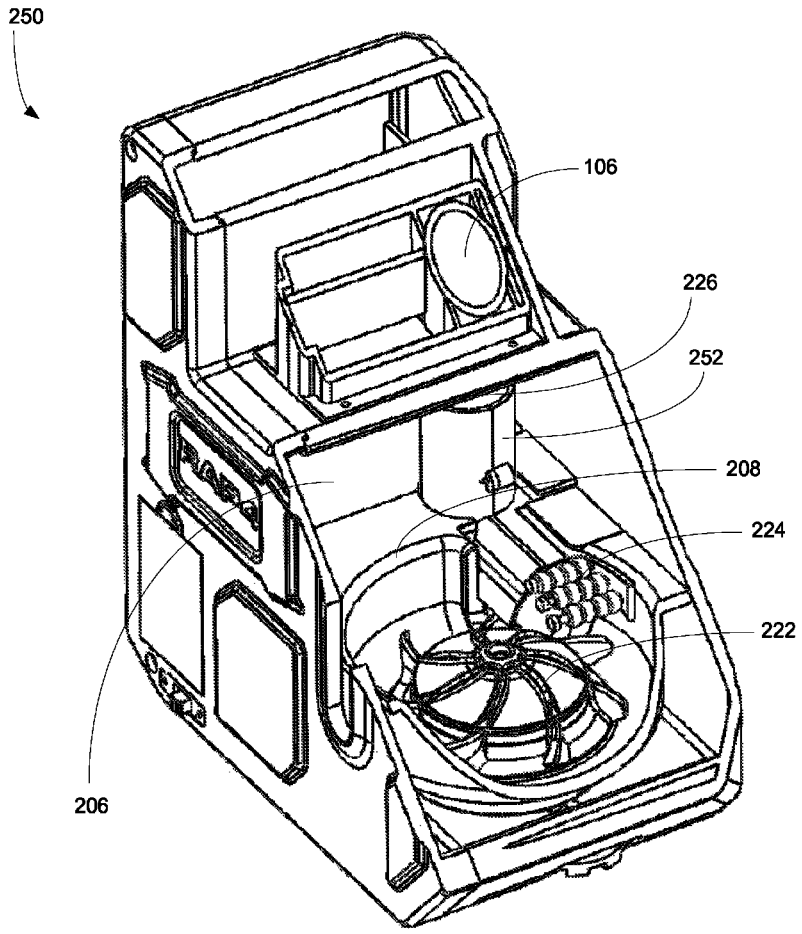

FIGS. 2A-C illustrate a cut-out view of a bottom feed magazine in accordance with one embodiment of the present invention. FIG. 2A illustrates a diagram 200 showing a cut-out view of the bottom feed magazine. FIG. 2B illustrates a diagram 220 showing a cut-out top view 230, a cut-out back view 124, a cut-out left view 234 of the bottom feed magazine. FIG. 2C illustrates a three-dimensional ("3D") diagonal cut view of a bottom feed magazine. Diagrams 200, 220, 250 illustrate a bottom feeding mechanism wherein a bottom feed magazine is situated approximately below a receiver and configured to push paintballs in a direction opposite of gravity to the receiver for launching. It should be noted that the underlying concept of the exemplary embodiment(s) of the present invention would not change if one or more components (or elements) were added to or removed from diagrams 200, 220, 250.

Diagram 200 includes a magazine housing 202, paintball reservoir 206, and a loading system 208. Although the shape of housing 202 is in a square or rectangular shape, housing 202 is not necessary to be a square or rectangular shape. Depending on applications, the magazine housing, for example, can be round, spherical, or triangle shape.

Paintball reservoir 206 is a room for storing or holding paintballs or paint projectiles. Depending on the types of paintballs used, the capacity of reservoir can change accordingly. Loading mechanism 208 includes a feed tube 226, an L-shaped tube 252, a paintball deflector 224, and a paddle wheel 222 as shown in diagrams 220 and 250. A function of loading system is to perform the bottom feeding mechanism which generates a force capable of pushing paintballs in a direction opposite of gravity into the receiver for launching.

Figure 3:
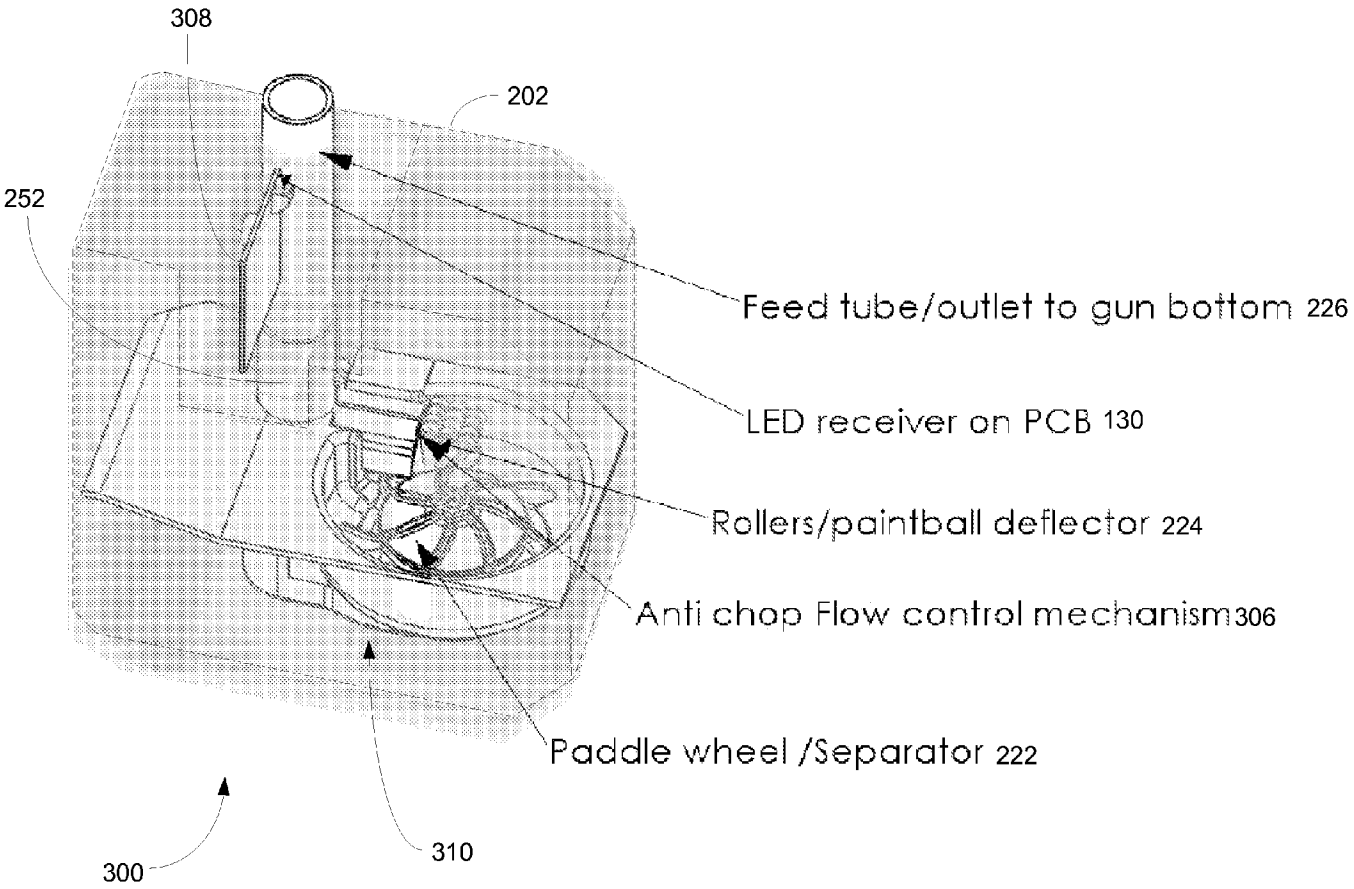
FIG. 3 is a diagram illustrating an internal structure of the bottom feed magazine in accordance with one embodiment of the present invention.

FIG. 3 is a diagram 300 illustrating an internal structure of the bottom feed magazine in accordance with one embodiment of the present invention. Diagram 300 includes a housing 202, a printed circuit board ("PCB") 308, a feed tube 226, an L-shaped tube 252, a paintball deflector 224, an anti-chopping flow control mechanism 306, a paddle wheel 222, and a driving component 310. Driving component 310, in an aspect, includes a motor, battery, and necessary mechanical parts to round paddle wheel 222. It should be noted that the underlying concept of the exemplary embodiment(s) of the present invention would not change if one or more components (or elements) were added to or removed from diagram 300.

Figure 4A:
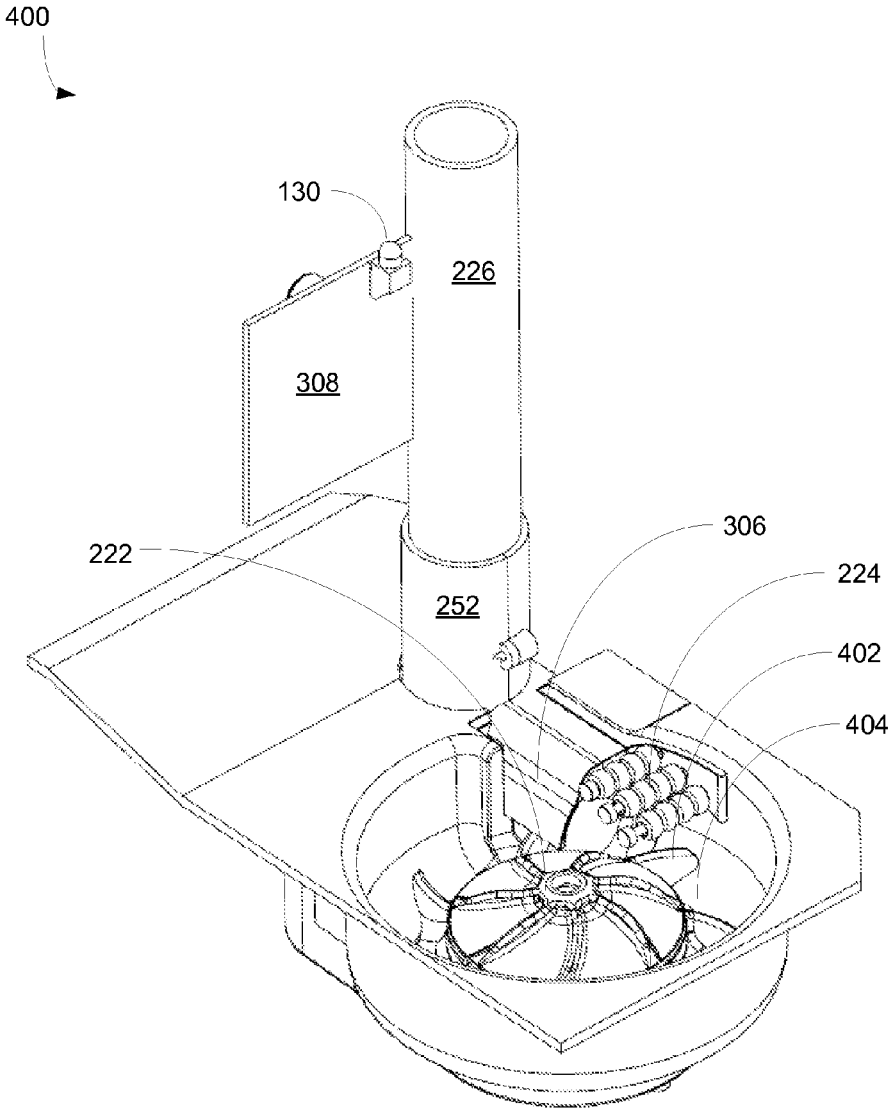
FIGS. 4A-C are diagrams illustrating various exemplary components of the bottom feed magazine in accordance with one embodiment of the present invention.
Figure 4B:
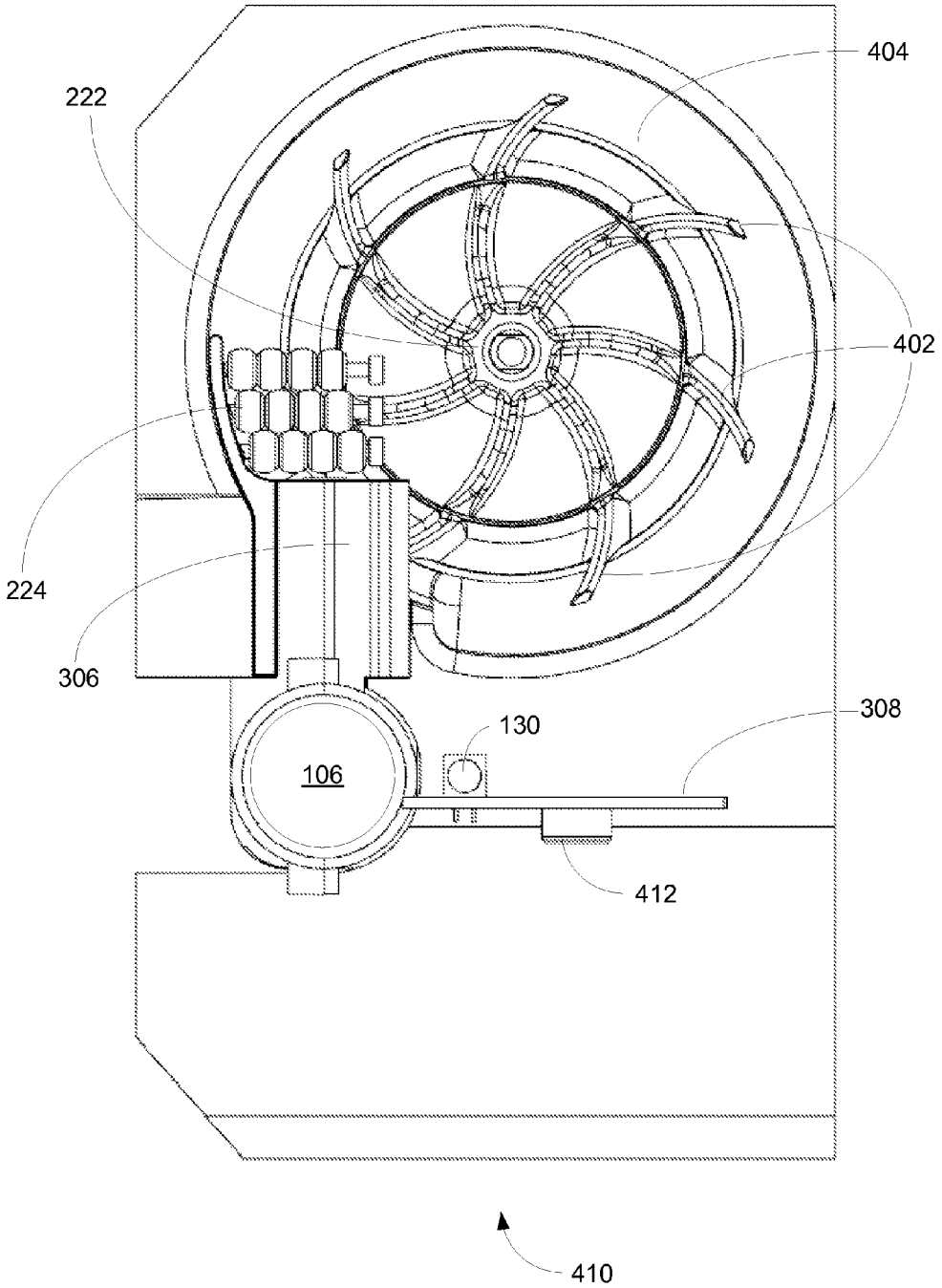
Figure 4C:
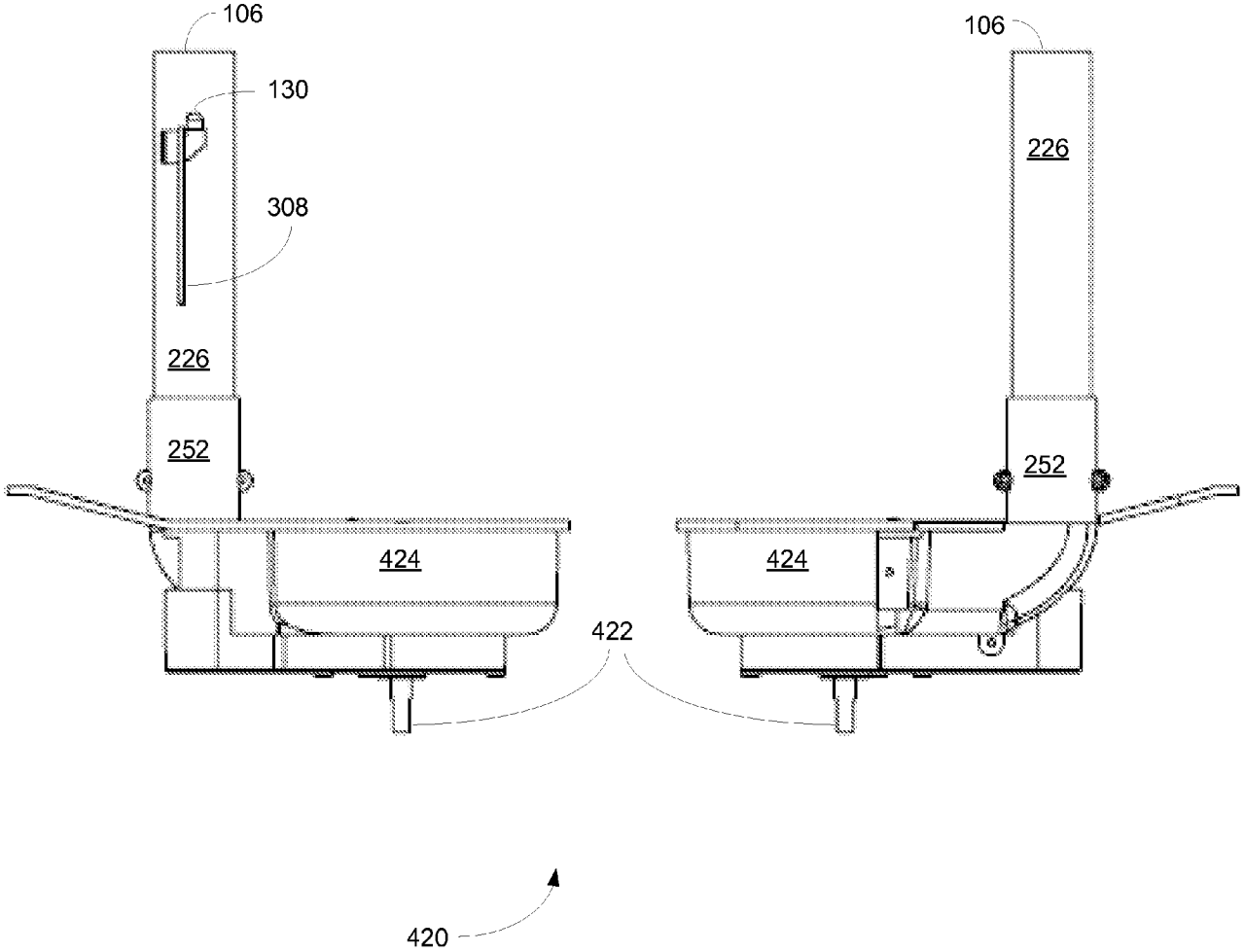

FIGS. 4A-C illustrate various exemplary components of the bottom feed mechanism for a bottom feed magazine in accordance with one embodiment of the present invention. FIG. 4A is a diagram 400 showing a bottom feed mechanism capable of generating a force to move a paintball upward against gravity into the chamber of a receiver for firing. FIG. 4B is a diagram 410 showing a top view of the bottom feed mechanism. FIG. 4C is a diagram illustrating side-views of the bottom feed mechanism. It should be noted that the underlying concept of the exemplary embodiment(s) of the present invention would not change if one or more components (or elements) were added to or removed from FIGS. 4A-C.

Diagram 400 illustrates a PCB 308, a feed tube 226, an L-shaped tube 252, a paintball deflector 224, an anti-chopping flow control mechanism 306, a paddle wheel 222, and an optical signal receiver 130. PCB 308 includes various circuits capable of generating loading signals to paddle wheel for turning in accordance with the optical signals received by optical signal receiver 130. In one embodiment, PCB 308 includes controllers capable of processing digital signals.

Feed tube 226, in one aspect, is structure in vertical position perpendicular to the floor of housing capable of moving the paintballs vertically into the receiver. One end of feed tube 226 is loading port 106 while another end of feed tube 226 is coupled to an end of L-shaped tube 252. In one aspect, feed tube 226 and L-shaped tube 252 are fabricated in a single pipe or tube. Feed tube 226, in one example, extends approximately the entire height of the bottom feed magazine.

L-shaped tube 252, also known as elbow, is a tube or pipe turning 90 degrees and used to transfer the direction of a force from a horizontal push to a vertical anti-gravity force lifting a paintball from the floor or bottom of the housing to loading port 106. Note that loading port 106, in one embodiment, extends into the receiver once the bottom feed magazine is clipped into the receiver of a paintball marker.

Paddle wheel 222, in one embodiment, includes multiple paddles 402 wherein space 404 between every two paddles is configured in such a way that space 404 is sufficient for housing one (1) paintball. As such, when paddle wheel 222 turns, one paintball enters into L-shaped tube 252 for each turn of paddle wheel 222. Note that paddle wheel 222 is coupled to a motor (not shown in the diagrams) via axis 422. A track bowl 424 is used to guide the paintballs to paddle wheel 222 for loading.

Paintball deflector 224 includes multiple small rollers to ascertain one paintball entering L-shaped tube at one time. Similarly, anti-chopping flow control mechanism 306 provides protection to entrance of L-shaped tube from chopping or damaging paintballs in the reservoir. Optical signal receiver 130 is able to detect a predefined light and instructs the motor to turn after processing.

Figure 5A:
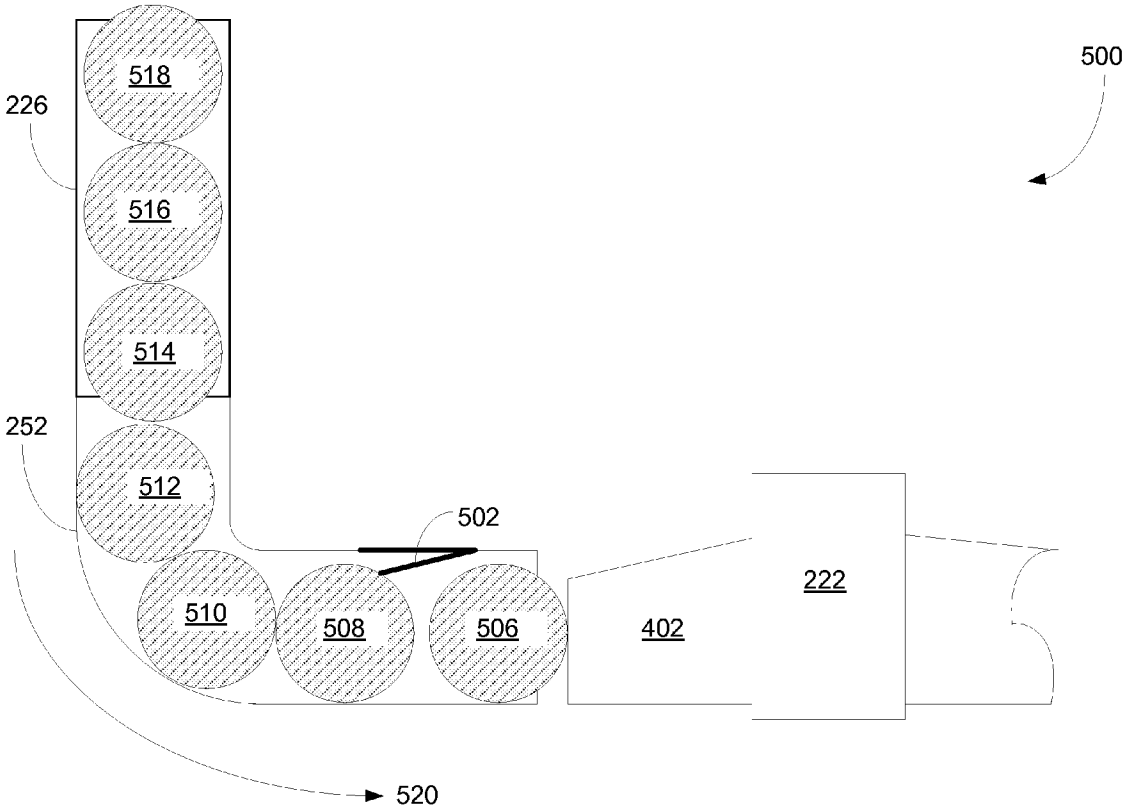
FIGS. 5A-B are diagrams illustrating an L-shaped tube having a stopper in accordance with one embodiment of the present invention.
Figure 5B:
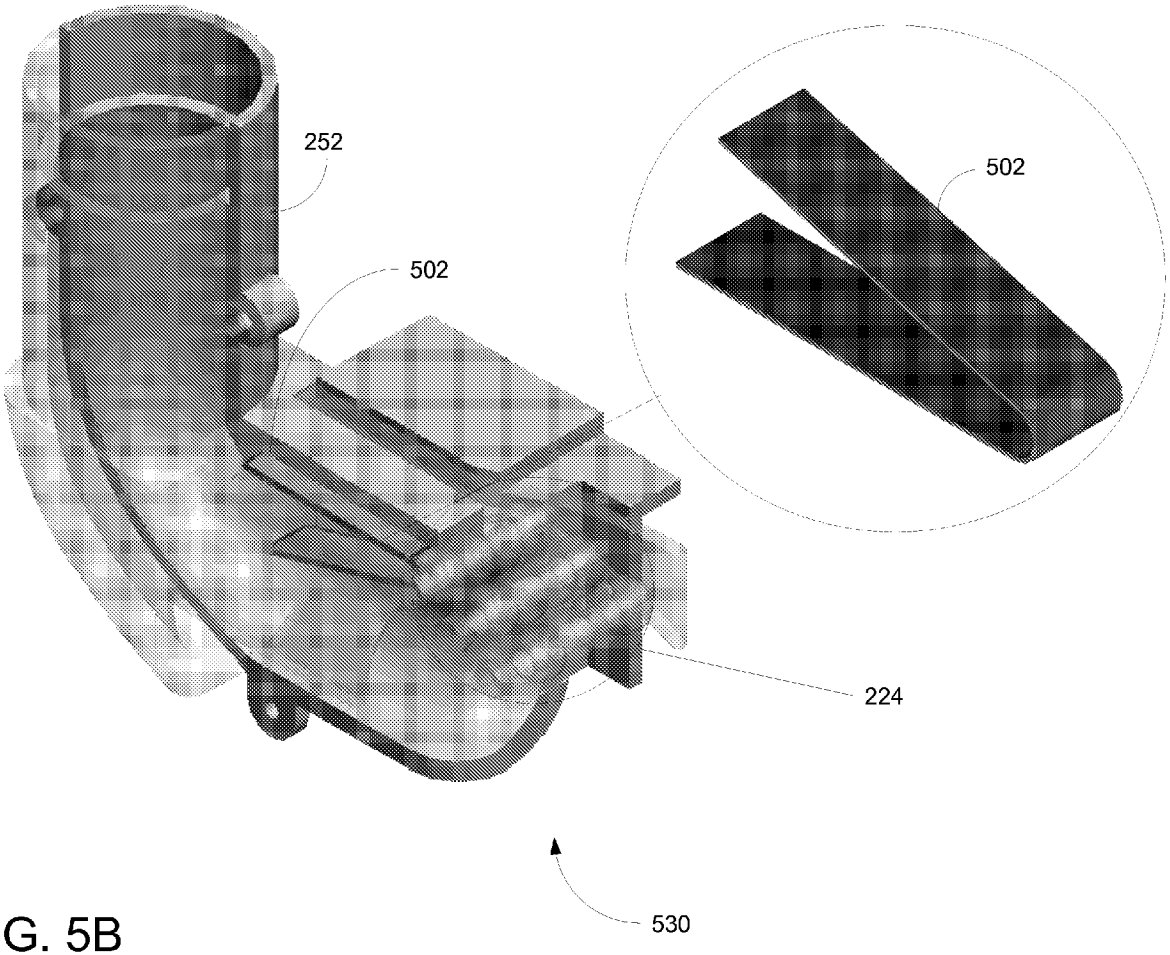

FIGS. 5A-B illustrate an L-shaped tube having a stopper in accordance with one embodiment of the present invention. FIG. 5A is a diagram 500 showing a stopper situated in L-shaped tube 252 capable of generating sufficient force to stop paintballs 508-581 from rolling in a direction 520 back into the paintball reservoir. In one embodiment, stop 502 is one-way stopper or one-way valve capable of holding paintballs 508-518 in position from touching paintball 506 which is ready to enter L-shaped tube when paddle wheel turns. In operation, when paddle wheel 222 turns and its paddle 402 pushes paintball 506 into L-shaped tube 252, the force generated by paddle 402 is sufficient to push all paintballs 506-518 upward to the receiver. Top paintball 518, in one example, will enter the chamber of receiver ready to be fired as soon as paddle wheel 222 turns.

FIG. 5B is a diagram 530 showing a 3D view of L-shaped tube 252 for the bottom feed mechanism. The one-way stopper is a v-shaped spring wherein one leg is used to attach to L-shaped tube 252 and another leg is used to hold paintballs in the tube. The one-way stopper, in one aspect, can be fabricated or casted with semi-flexible materials, such as metal, aluminum, polymers, composite plastics, rubbers, and the like. It should be noted that one-way stopper can be any other form or shape other than v-shaped spring as long as it can perform similar stopping or holding functions.

Figure 6A:
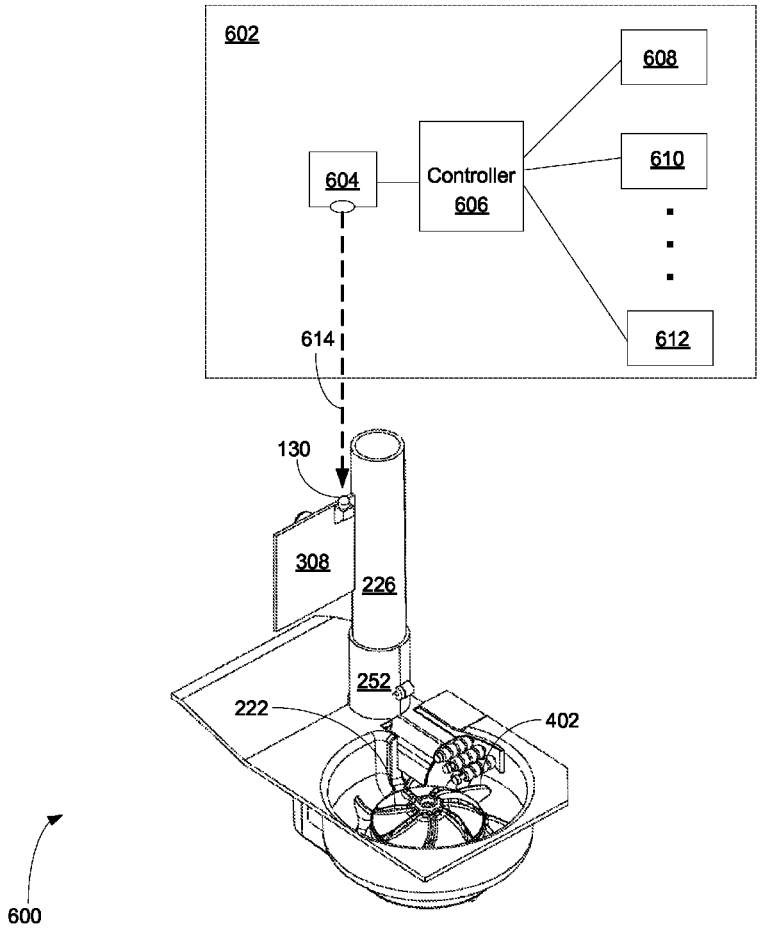
FIGS. 6A-B are diagrams illustrating feeding communication between a receiver and a bottom feed magazine in accordance with one embodiment of the present invention.
Figure 6B:
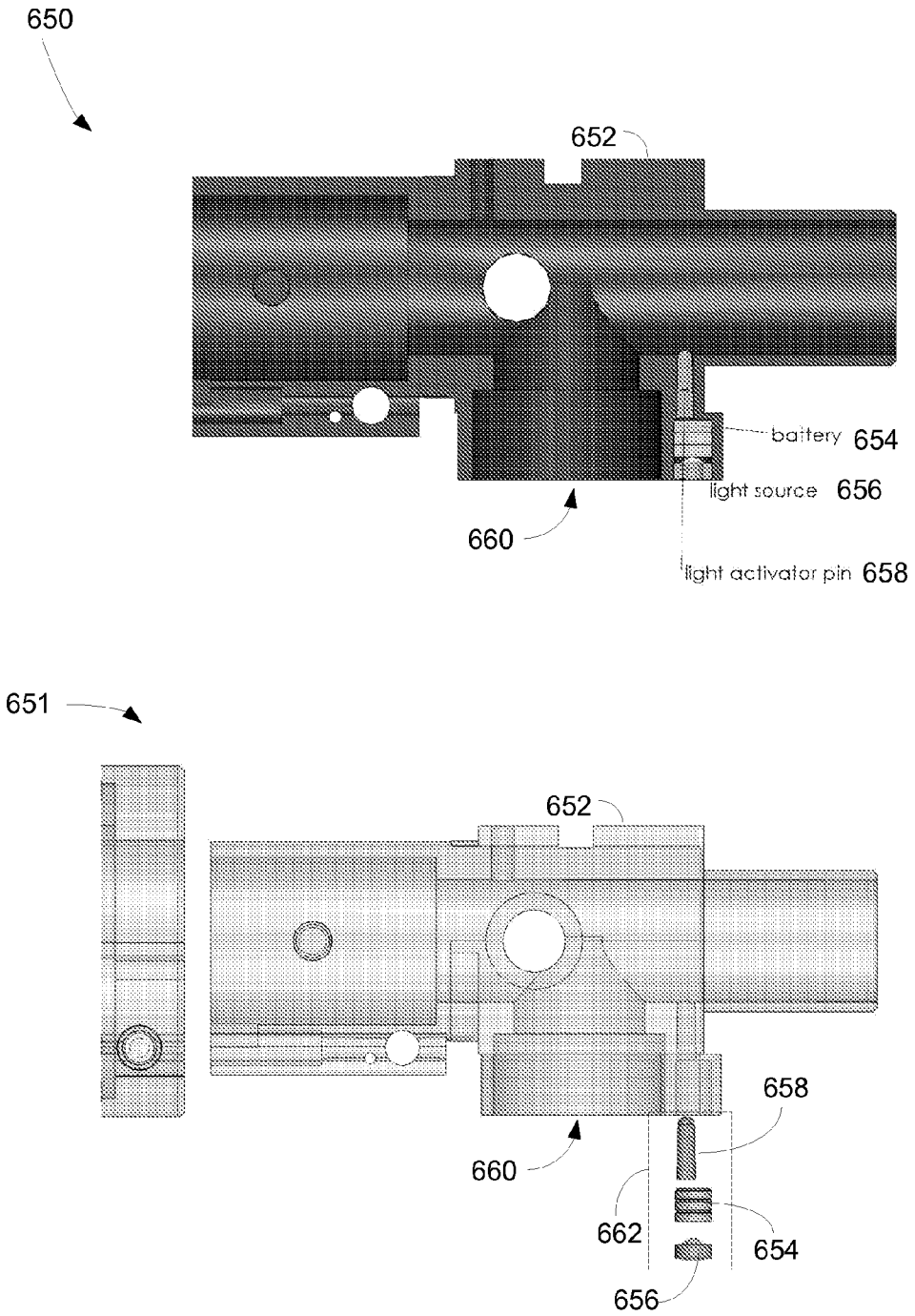

FIGS. 6A-B illustrating feeding communication between a receiver and a bottom feed magazine in accordance with one embodiment of the present invention. FIG. 6A is a diagram 600 showing a bottom feed magazine communicating with the receiver using optical signals. Diagram 600 includes a feeding requester 602 capable of emitting an optical signal 614 to optical signal receiver 130 requesting loading. In one embodiment, feeding requester 602, which is installed in the receiver, includes a controller 606, light emitting device ("LED") 604, and various sensors 608-610. Sensors 608-610 may be micro-electro-mechanical system ("MEMS") based sensing devices capable of detecting pressure, sound, motion, temperature, moisture, et cetera. Depending on applications or types of receivers used, one or multiple types of sensors may be installed to detect each release of a paintball. Upon detecting a firing or releasing a paintball, one or more sensors send a firing signal(s) to controller 606 which will subsequently instruct LED 604 to emit a predefined or pre-programmed light indicating that a loading is needed from the bottom feed magazine.

FIG. 6B illustrates two diagram 650-651 showing a receiver 652 having an LED component 662 and a bottom feed port 660 in accordance with one embodiment of the present invention. LED component 662 includes a light activate pin 658, battery 654, and light source 656. It should be noted that LED component 662 is an exemplary illustration and LED component can be constructed in various different ways.

In one embodiment, a paint projectile propelling device or a paintball marker includes a feed tube, a paddle wheel, an L-shaped tube, and one-way stopper. The feed tube has a top end and a bottom end and is configured to facilitate passage paintballs from the bottom feed magazine to the paintball marker. The top end of feed tube reaches to approximately the top surface of the bottom feed magazine. The feed tube is situated in such a way that the feed tube extends approximately from the bottom of feed magazine to the top of feed magazine. The paddle wheel has multiple paddles and is configured to generate a force capable of pushing multiple paintballs in the feed tube in a direction against gravity toward the paintball marker. The paddle wheel is configured to move in a rotational direction driven by a battery powered motor.

The L-shaped tube has a top end coupled to the feed tube and a bottom end coupled to the paddle wheel. The L-shaped tube is configured to guide at least one paintball from the paddle wheel to the feed tube. In one aspect, the L-shaped tube is configured to transfer a horizontal force to a vertical anti-gravitational force.

The one-way stopper is installed or situated in the L-shaped tube and is configured to hold the paintballs in the feed tube. The one-way stopper is a flexible V-shaped spring capable of performing a function of one-way valve to maintain the paintballs in the feed tube from touching the paddles of the paddle wheel. The one-way stopper is a stopper fabricated in flexible materials.

The paintball marker also includes a receiver having a top surface and a bottom surface. The bottom surface of the receiver includes a bottom feed port. The top surface facing upward and the bottom surface facing downward at ground. The bottom feed magazine includes a magazine housing configured to house the feed tube, the paddle wheel, the L-shaped tube, and a one-way stopper. The magazine housing includes mechanical latches configured to couple with the receiver.

The receiver includes a feed sensor and an optical feed requester, wherein the feed sensor includes electronic circuitry capable of issuing a feed requesting signal upon detecting a load condition. The optical feed requester is configured to issue an optical signal to the bottom feed magazine in response to the feed requesting signal. The feed sensor may include MEMS configured to detect one of pressure, sound, and motion. Note that an optical receiver is configured to receive an optical signal for loading and it subsequently sends a loading signal to the paddle wheel for feeding.

Figure 7A:
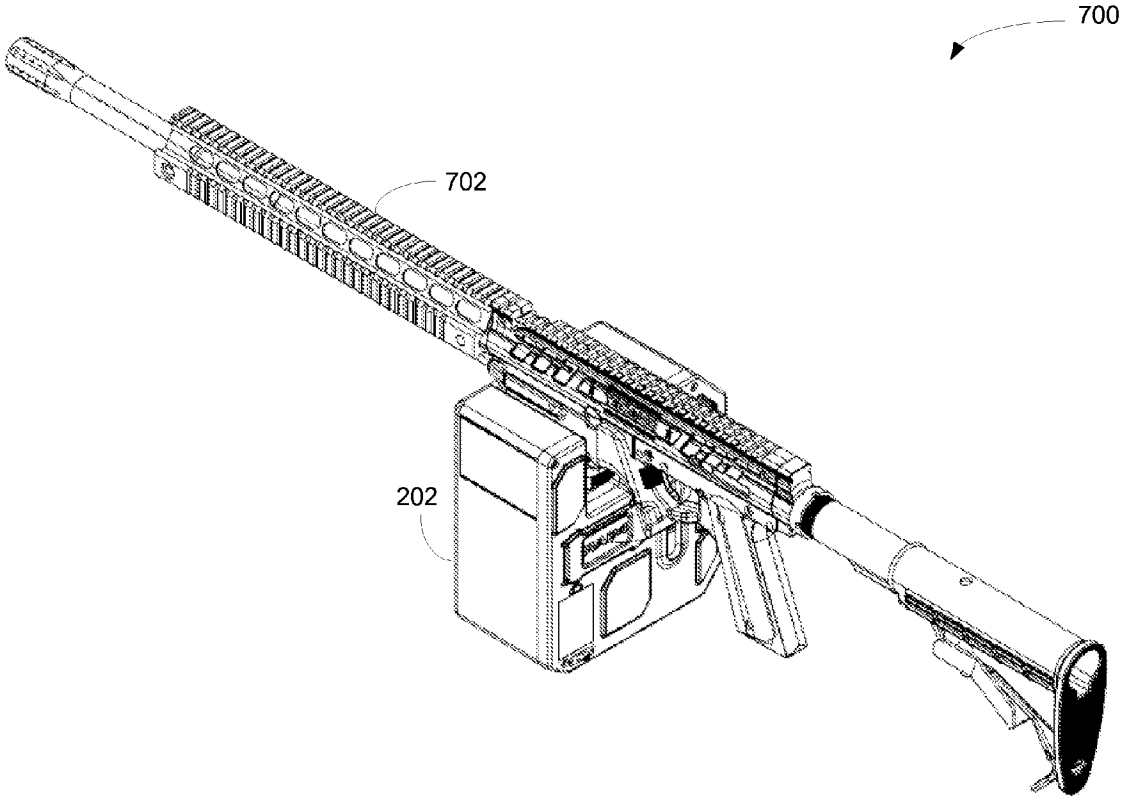
FIGS. 7A-B are diagrams showing a bottom magazine coupling to a paintball marker in accordance with one embodiment of the present invention.
Figure 7B:
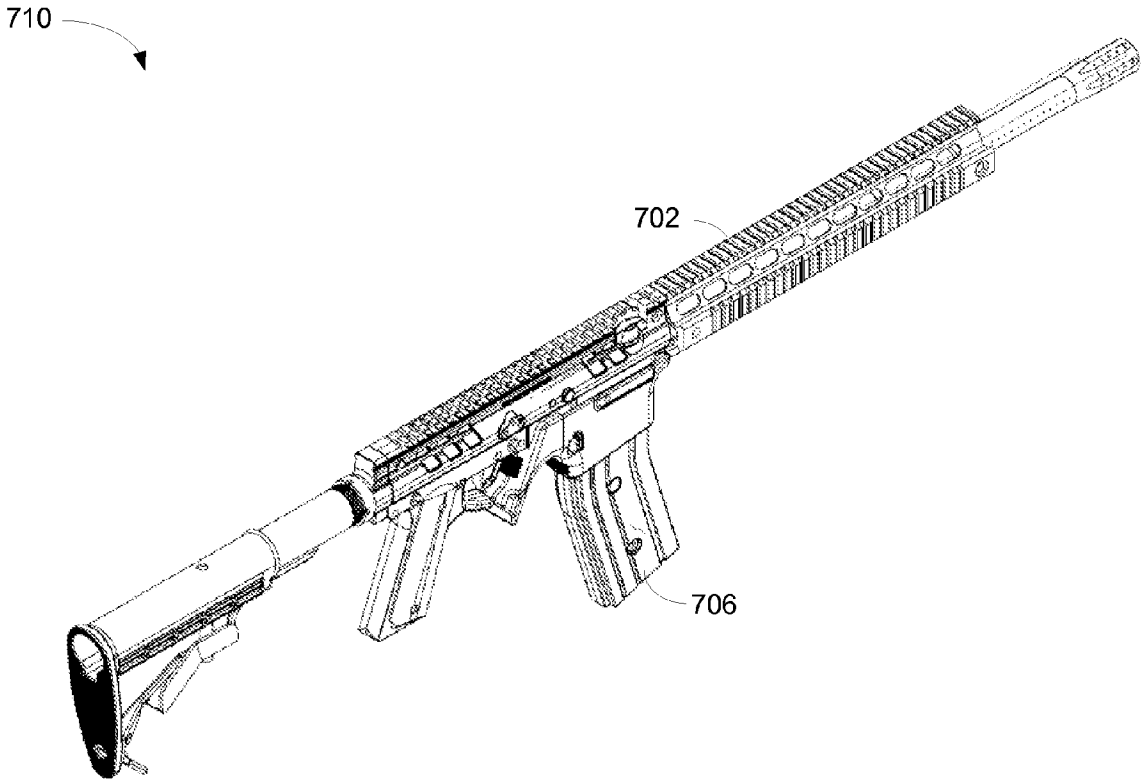

FIGS. 7A-B are diagrams showing a bottom magazine coupling to a paintball marker in accordance with one embodiment of the present invention. FIG. 7A is a diagram 700 showing a bottom feed magazine attached to a paintball marker 702 capable of accepting bottom feeding mechanism. FIG. 7B is a diagram 710 showing a bottom feed magazine attached to a paintball marker 702 capable of accepting bottom feeding mechanism wherein the bottom feed magazine is a different designed magazine clip which has a more realistic look. It should be noted that the underlying concept of the exemplary embodiment(s) of the present invention would not change if one or more components such as buttstock and compressed air tanks were added to or removed from diagrams 700 and 710.

An advantage of employing the disclosed embodiments of bottom feed magazine is to allow a paintball operator to replace a traditional top loading paintball marker with a bottom feed magazine. For example, embodiments of the present invention allow existing paintball guns to use the bottom feed magazines with minor retrofitting. The existing paintball guns may include, but not limited to, Tippmann 98™, Tippmann A5™, Tippmann X7™, Tippmann X7 Phenom™, BT Combat™, BT Delta™, BT SWAT™, BT4™, US Army Alpha Black™, US Army Project Salvo™, US Army Carver One™, and Valken SW-1™.

An advantage of using the embodiments of the present invention is to allow an operator to have a clear line of fire without obstruction such as a top loading apparatus such as a hopper.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A paint projectile propelling device comprising:

a feed tube, having a first end and a second end, configured to facilitate passage paintballs from a bottom feed magazine to a paintball marker, wherein the first end of feed tube reaches to approximately top surface of the bottom feed magazine;

a paddle wheel, having a plurality of paddles, configured to generate a force capable of pushing a plurality of paintballs in the feed tube in a direction against gravity toward the paintball marker, wherein the paddle wheel is configured to turn around an axis which is situated in parallel to the feed tube;

an L-shaped tube having a first end coupled to the feed tube and a second end coupled to the paddle wheel, wherein the L-shaped tube is a hollow cylinder containing a curved section configured to adjust moving direction of at least one paintball from the paddle wheel to the feed tube; and a one-way stopper constructed in a V-shaped flexible structure and situated in the L-shaped tube and configured to hold the plurality of paintballs in the feed tube, and a deflector, having at least a roller, coupled to the L-shaped tube and configured to control the paintballs entering the L-shaped tube.

2. The device of claim 1, further comprising a receiver having a top surface and a bottom surface, wherein the bottom surface of the receiver includes a bottom feed port, wherein the top surface facing upward and the bottom surface facing downward at ground.

3. The device of claim 2, further comprising a magazine housing configured to house the feed tube, the paddle wheel, the L-shaped tube, and a one-way stopper, wherein the magazine housing includes mechanical latches configured to couple with the receiver.

4. The device of claim 2, wherein the receiver includes a feed sensor and an optical feed requester.

5. The device of claim 4, wherein the feed sensor includes electronic circuitry capable of issuing a feed requesting signal upon detecting a load condition.

6. The device of claim 5, wherein the optical feed requester issues an optical signal to the bottom feed magazine in response to the feed requesting signal.

7. The device of claim 4, wherein the feed sensor further includes micro-electro-mechanical system ("MEMS") configured to detect one of pressure, sound, and motion.

8. The device of claim 1, further includes an optical receiver configured to receive an optical signal for loading.

9. The device of claim 1, wherein the optical receiver sends a loading signal to the paddle wheel for feeding.

10. The device of claim 1, wherein the feed tube is situated in such a way that the feed tube extends approximately from bottom of feed magazine to top of feed magazine.

11. The device of claim 1, wherein the paddle wheel is configured to move in a rotational direction driven by a battery powered motor.

12. The device of claim 1, wherein the L-shaped tube is configured to transfer a horizontal force to a vertical anti-gravitational force.

13. The device of claim 1, wherein the one-way stopper is a flexible V-shaped spring capable of performing a function of one-way valve to maintain the plurality of paintballs in the feed tube from touching the paddles of the paddle wheel.

14. The device of claim 1, wherein the one-way stopper is a stopper fabricated in flexible materials configured to function as a one-way valve to maintain the plurality of paintballs in the feed tube from touching the paddles of the paddle wheel.

15. A paintball propelling device comprising:

a receiver having a top surface facing upward and a bottom surface facing downward at ground, wherein the bottom surface of the receiver includes a bottom feed port; and a bottom feed magazine coupled to the bottom surface of the receiver and configured to provide paintballs to the receiver via the bottom feed port, wherein the bottom feed magazine includes, a feed tube facilitating to transfer the paintballs from bottom of the bottom feed magazine to top of the bottom feed magazine;

a paddle wheel coupled to the feed tube and configured to turn around an axis which is situated in parallel to the feed tube;

an L-shaped tube, having a first end and a second end, constructed in a hollow cylinder containing a curved section configured to push one or more paintballs from the first end to the second end of the L-shaped tube, wherein the second end of L-shaped tube is coupled to the feed tube;

wherein the L-shaped tube includes a deflector with at least a roller configured to control paintballs entering the L-shaped tube;

a one-way paintball stopper coupled to the L-shaped tube and configured to hold a plurality of paintballs in the feed tube, wherein the one-way paintball stopper is a flexible V-shaped spring.

16. The device of claim 15, wherein the receiver includes a feed sensor and an optical feed requester, wherein the feed sensor includes electronic circuitry capable of issuing a feed requesting signal upon detecting a load condition.

17. The device of claim 15, wherein the bottom feed magazine further includes an optical receiver configured to receive an optical signal from the receiver for loading.

18. The device of claim 15, wherein the one-way stopper is a flexible V-shaped spring capable of performing a function of one-way valve to maintain the plurality of paintballs in the feed tube from touching the paddles of the paddle wheel.

19. A paintball assembly comprising:

a receiver with a top surface and a bottom surface, the receiver including an optical signal component, wherein the optical signal component is configured to emit an optical signal requesting paintball loading in accordance with launching of a paintball; and a bottom feed magazine coupled to the bottom surface of the receiver and configured to provide paintballs to the receiver via a bottom feed port in response to the optical signal, wherein the bottom feed magazine includes a hollow cylindrical pipe with a bending section configured to guide paintball traveling direction, wherein the hollow cylindrical pipe includes a deflector with at least a roller configured to control the paintballs entering the hollow cylindrical pipe, a paddle wheel configured to turn around an axis which is situated in a parallel to at least the hollow cylindrical pipe, a one-way stopper constructed in flexible V-shaped material and configured to prevent a plurality of paintballs in feed tube from rolling back to a paddle wheel.

20. The assembly of claim 19, wherein the bottom feed magazine includes, wherein the hollow cylindrical pipe is an L-shaped tube, having a first end and a second end, configured to push one or more paintballs from the first end to the second end of the L-shaped tube, wherein the second end of L-shaped tube is coupled to the feed tube.

* * * * *